United States Patent [19]

Ziethen et al.

[11] Patent Number: 4,925,135

[45] Date of Patent: May 15, 1990

[54] ARRANGEMENT FOR CONTROLLED GUIDANCE OF A WHEEL AXLE OR OF A BOGIE OF A RAIL VEHICLE PASSING OVER POINTS

[75] Inventors: Rüdiger Ziethen, Friedrichsdorf; Sebastian Benenowski, Butzbach; Alfred Kais, Lich; Erich Nuding, Linden, all of Fed. Rep. of Germany

[73] Assignee: BWG Butzbacher Weichenbau GmbH, Butzbach, Fed. Rep. of Germany

[21] Appl. No.: 148,735

[22] Filed: Jan. 26, 1988

[30] Foreign Application Priority Data

Jun. 15, 1987 [DE] Fed. Rep. of Germany ..... 3719925
Oct. 26, 1987 [DE] Fed. Rep. of Germany ..... 3736217

[51] Int. Cl.[5] ..... E01B 7/00
[52] U.S. Cl. ..... 246/436
[58] Field of Search ..... 246/435 R, 436, 446; 238/15, 121

[56] References Cited

U.S. PATENT DOCUMENTS

| | | | |
|---|---|---|---|
| 137,050 | 3/1873 | Billings | 246/436 |
| 193,206 | 7/1877 | Ainsworth | 246/436 |
| 391,168 | 10/1888 | Mansfield | 246/436 |
| 3,496,882 | 2/1970 | Campbell et al. | 238/15 |

FOREIGN PATENT DOCUMENTS

| | | | |
|---|---|---|---|
| 22082 | of 1896 | United Kingdom | 246/446 |

*Primary Examiner*—Margaret A. Focarino
*Assistant Examiner*—Frank Williams, Jr.
*Attorney, Agent, or Firm*—Beveridge, DeGrandi & Weilacher

[57] ABSTRACT

An arrangement is proposed for controlled guidance of a wheel axle (22) or of a bogie of a rail vehicle passing over points, whereby the wheel contact point (48, 50) is subjected to a controlled influence such that the wheel axle runs substantially vertical to the track longitudinal axis. The controlled influence of the wheel contact point can be exerted by, for example, the stock rail (32) veering away outwards in the area that the blade begins.

12 Claims, 9 Drawing Sheets

ARRANGEMENT FOR CONTROLLED GUIDANCE OF A WHEEL AXLE OR OF A BOGIE OF A RAIL VEHICLE PASSING OVER POINTS

BACKGROUND OF THE INVENTION

The invention relates to an arrangement for controlled guidance of an axle or bogie of a rail vehicle passing over points, where the wheels are each supported on the stock rails in a wheel contact point, and the stock rail of the main and branch tracks forming an angle is designed rigid and the switch blades movable.

Around points, there is unwelcome wear on the wheel flanges and, in connection with this, abrasion of the flanks on the running edge sides at the beginnings of the blades. This in turn leads inevitably to intensive maintenance work and frequent replacements of the parts in question, the costs of which are considerable in the superstructure sector.

It would therefore be desirable to create, to the fullest extent possible, track conditions in the area of points, thereby reducing wear and also increasing travelling comfort.

Object of the Invention

The object of the present invention is therefore to design an arrangement of the type mentioned above in such a way that a movement which is substantially of a purely rolling nature and not a dragging one takes place in the transitional zone between the stock rail and the blade, while at the same time obtaining optimum travel comfort. This should be achieved regardless of the points radius.

The object is achieved in accordance with the invention largely by the course of one stock rail at least deviating from the basic course in such a way that the wheel contact point is effectively influenced for selective alignment of the wheel or bogie axle on the track longitudinal axis or on angle bisector passing between the main and the branch track. By basic course is understood the course of the stock rail prevailing with normal points geometry and layouts. At least the stock rail in the principal direction of travel—whether this is the main or the branch track—deviates from the basic course. Preferably, however, both stock rails deviate from the basic course, so they veer away to the outside, i.e. away from the respective track axis.

Alignment of the wheel axle on the track longitudinal axis or the angle bisector between the main and the branch track now depends on which travel direction has been given priority. If both the main and the branch track are crossed with equal frequency, the change in the course is aligned so that the wheel axle adjusts substantially to the angle bisector, i.e. is aligned approximately vertical to the latter, in such a way that the dragging motions that are to be prevented in accordance with the object of the invention are avoided. The change in the stock rail course from the usual basic course in points designed to the prior art results in the advantage that the wheel contact point is so effectively influenced that track-like conditions prevail for the wheels so that the usual change in the wheel contact points when points are crossed is avoided as well as the resultant change in the angle velocity.

The bulges themselves can be composed of straight sections that describe angles in relation to one another and that continuously merge into one another.

The arrangement according to the invention has the advantage that points can be crossed at high speed without the occurrence of wear leading prematurely to irreparable damage. In particular, it is ensured that the wheel flange touches the blade as little as possible. Accordingly, track-like conditions prevail very early on in the transition area between stock rail and blade rail. Travelling comfort is not diminished in any way by the arrangement in accordance with the invention, indeed travelling characteristics are now possible that correspond to those on a normal track. It is not important here from which direction points are crossed, since there is a smooth transition between blade and stock rail. The arrangement in accordance with the invention and the points design this involves cannot be compared with a blade used and known from the prior art. In a structure of that type, it is well known that there is a break between the stock rail and the blade rail, so that not only does considerable wear result in this area, but also non-problematic crossing is only possible from one direction. In addition, there is here no controlled influence on the wheel contact point, so that the wheel flange continues to run against the blade for an undesirable length of time.

The proposed solution according to the invention, which is characterized by the veering of the stock rail away from the direction of the rail stretch usually specified by the prior art (basic course), and which ensures that an unwelcome drift of the wheel contact point, i.e. turning of the wheel axle in relation to the track axis, is prevented, can likewise not be compared with stub points, which are characterized by a movable stock rail. Apart from the fact that a construction of this type is complex and expensive, firm support of the blade against the moving stock rail is not possible, so that such stub points are unsuitable for high-speed stretches in particular. In addition, a butt joint is used that leads to considerably diminished travel comfort.

Moreover, the change in course of the stock rail cannot be compared with gauge widening in points with small radius. There must be sufficient space available here in order to ensure movability of the bogie. It is therefore necesary to widen the gauge in the case of points with low radius, with this widening being continued in the points without thereby exerting a controlled influence on the wheel contact point. In other words, there is no controlled guidance of the axle, with the result that there is still a dragging motion between the wheel flange and the blade. The gauge widening does not have a selective effect on the wheel contact point.

With the theory in accordance with the invention, an arrangement is therefore provided whereby the wheel contact point is influenced in such a way that as a mean there is a right angle between the wheel axle and the required track axis—whether main or branch track axis—or the angle bisector running between these, regardless of the points diameter. This ensures that—regardless of whether the rail vehicle is running on the main or the branch track—the points can be crossed at high speed without causing marked wear on the wheel flange and blade. Accordingly, the transitional area from stock rail to blade rail is designed with track-like conditions, which are particularly required for high-speed points.

The invention is notable in particular for the fact that the course change of one of the stock rails is always substantially at the start of the points curve. For example in the case of large-arc points with a curvature radius $r_1 > 500{,}000$ mm the course of the branch track changes at the beginning of the curve, and the course of the main track in or after the beginning of the curve, whereas with small-arc points with a curvature radius $r_2 < 500{,}000$ mm the course of the main track changes in the beginning of the curve and that of the branch track before the beginning of the curve.

Furthermore, optimum travelling characteristics are obtained in the points when the end x of the course change in the main track after the start of the curve is made dependent on curvature radius R and head width F of the stock rail. The end x of the course change in the case of points substantially tracing a circular arc is therefore calculated using the relationship $x=\sqrt{R^2-(R-y)^2}$, with $y=c\cdot F$, where 0.5 should be $\leqq c \leqq 1$. These equations result, for example in the case of points with a curvature radius of $R=7{,}000{,}000$ mm and a head width F of 72 mm with $c=1$, in the end point x from the beginning of the curve of $x=31{,}749$ mm.

As an alternative to the stock rail course change, controlled and selective influencing of the wheel contact point can be achieved by changing the cross section of at least one stock rail in the area of the points in relation to that outside the points such that the wheel contact point is effectively influenced for selective alignment of the wheel axle or bogie axle on the track longitudinal axis or angle bisector. In particular, it is possible for the profile of the stock rail to be flattened off towards the blade in order to change the possible wheel contact point, or for the vertical axis of the stock rail to be inclined for a controlled change of the wheel contact point.

Further details and features of the invention can be found in the claims and in the features which can be gathered therefrom, whether singly or in combination.

Based on the following description of embodiments shown in the drawing, there are further details, advantages and features of the invention.

DETAILED DESCRIPTION OF THE PREFERRED EMBODIMENTS

Figure 1:
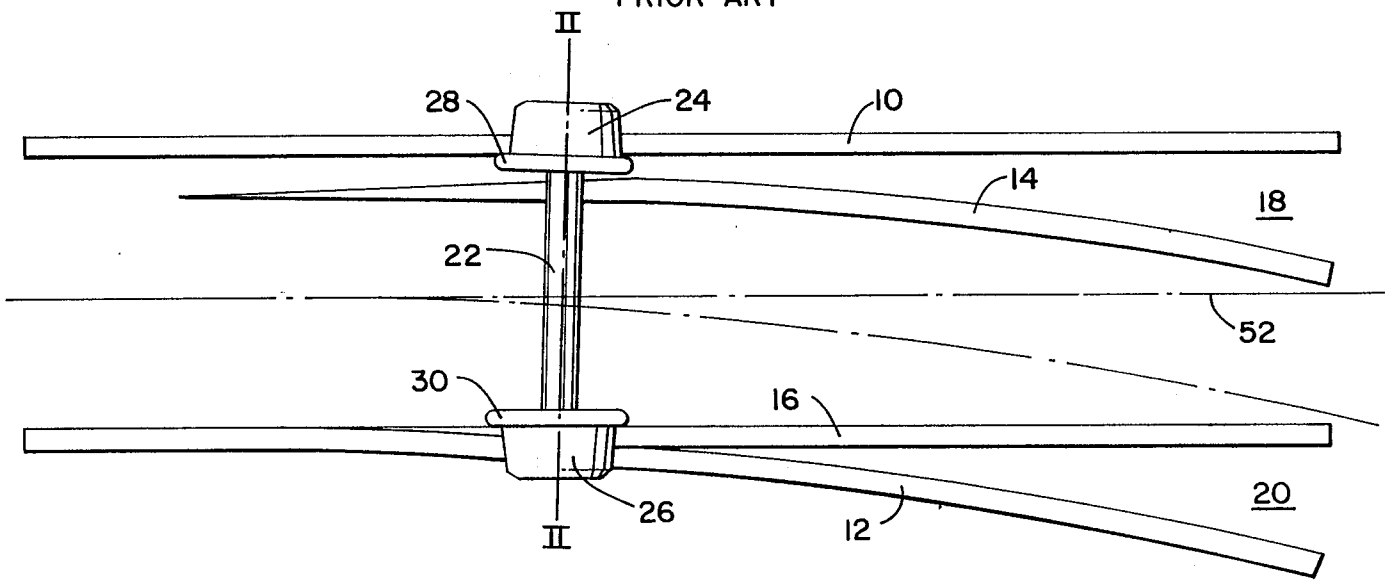
FIG. 1 PRIOR ART
FIG. 1 shows a plan view of a section of points to the prior art.

In FIG. 1, a section of points known from the prior art is illustrated, comprising stock rails (10), (12) with associated blades (14) and (16) that contact optionally one of the rigid stock rails (10) and (12), depending on whether the main track (18) or the branch track (20) is to be traversed. It is not necessary to go into greater detail in this case, as well-known design features such as the slide chair and the frog point can be used.

In the embodiment, the main track (18) is to be crossed by a rail vehicle. Shown is a wheel axle (22) with wheels (24) and (26) each having a wheel flange (28) and (30). It can also be seen that the wheels (24) and (26) are designed tapering, i.e. decrease towards their ends. The wheel (24) is in contact with the stock rail in the wheel contact point (46), so that an effective wheel diameter $D_1$ becomes noticeable. The wheel (26), when in the transitional area from the stock rail (12) to the blade rail (16), contacts in a wheel contact point (44) the stock rail (12) in order to be supported on the blade rail (16) during further movement in the direction of the main track (18). An effective diameter $D_2$ is assigned to wheel contact point (44). Since $D_1$ and $D_2$ differ, a swivel motion of the axle (22) takes place, leading inevitably to the wheel flange (30) dragging on the inner flank of the blade rail (16) and resulting in considerable wear. The result of this is travelling conditions that do not meet those on a normal track. The travelling conditions also depend here on whether the points are to be traversed on the main track (18) or branch track (20).

The present invention proposes that the stock rails (10) and (12) be so designed that a change in the wheel contact point takes place in a controlled manner such that the wheel axle adjusts largely vertical to the axis of the main track or branch track. As a result, the wheel flange does not drag along the blade rail. This not only increases travelling comfort, but also permits points of this type to be crossed at higher speeds. Track conditions therefore prevail within the transitional area of stock rail and blade rail.

Figure 2:
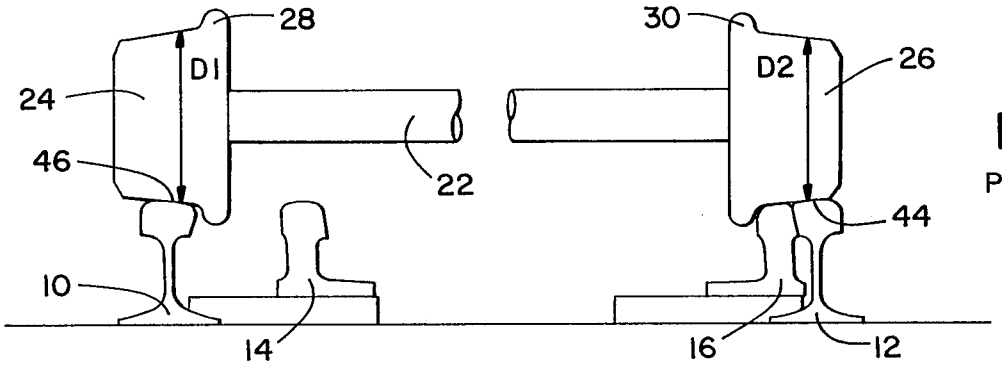
FIG. 2 PRIOR ART
FIG. 2 shows a sectional view along the line II—II in FIG. 1 in magnified form.
Figure 3:
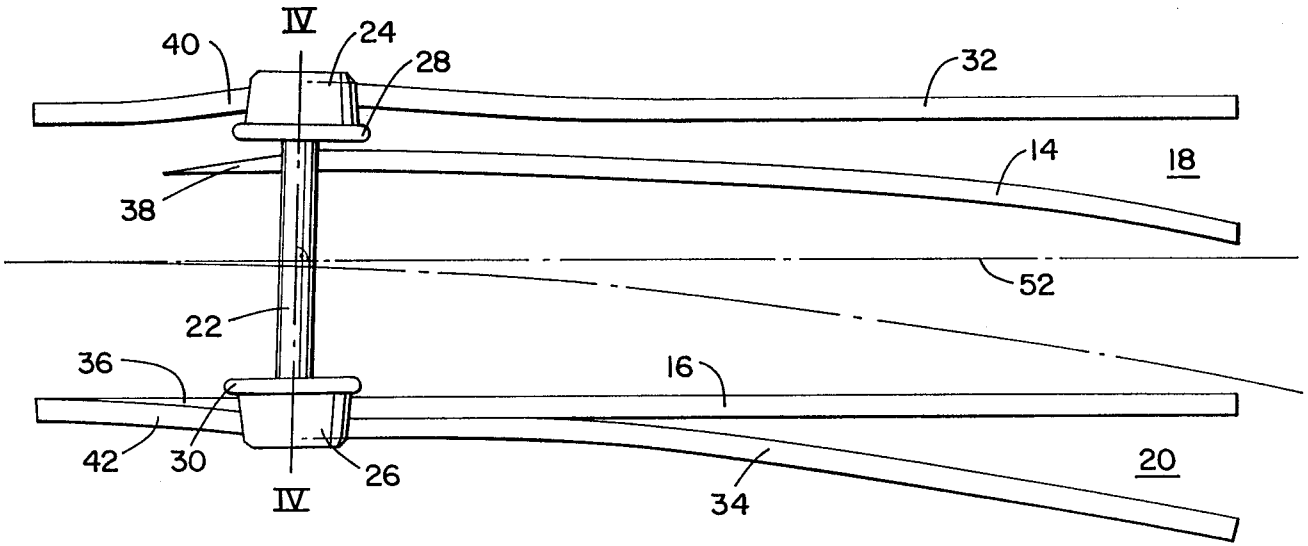
FIG. 3 shows a section of a first embodiment of points in accordance with the invention.
Figure 4:
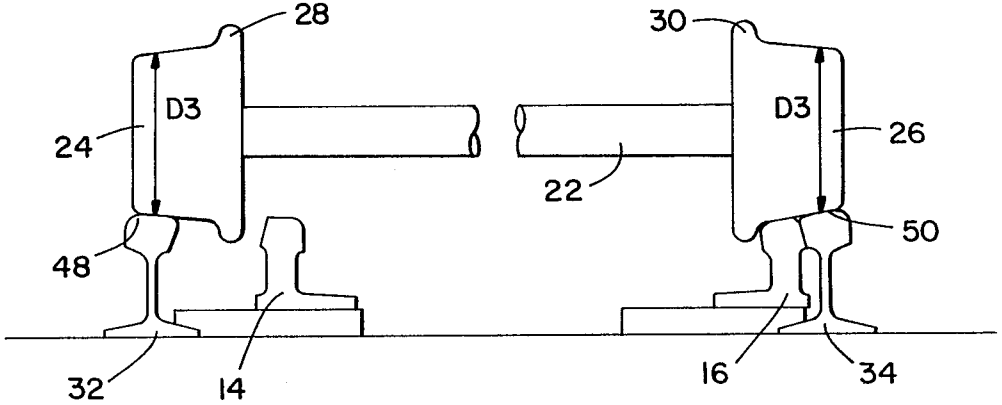
FIG. 4 shows a sectional view along the line IV—IV in FIG. 3, FIGS. 5 to 7 show various embodiments and arrangements of a stock rail

FIG. 3 is a first embodiment of a points arrangement in accordance with the invention. Here, elements corresponding to those in FIGS. 1 and 2 are—as in the following description too—numbered identically. Stock rails (32) and (34) are associated with blade rails (14) and (16) that veer outwards and away from the original direction in the area where the blades (36) and (38) of blade rails (14) and (16) begin. The stock rails (32) and (34) therefore have bulges in the areas (40) and (42) in which the beginnings of the blades (36) and (38) are in contact with stock rails (32) and (34) and smoothly merge into them. The bulges (40) and (42) permit controlled influencing of the wheel contact point (48) on the stock rail (32) when this area (40) is being traversed, in such a way that an effective rolling diameter $D_3$ results. With an identical diameter $D_3$ the wheel (26) is in contact with the stock rail (12) (reference 50) so that it is ensured here that the axle (22) runs substantially vertical to the track longitudinal axis (52). This in its turn has the effect that the wheel (26) rolls exclusively on the stock rail (34) and then on the blade rail (16) without dragging along the side of said blade rail.

Strictly speaking, the axle (22) does not remain continuously at a right angle to the main track longitudinal axis (52) when traversing the area (40) and (42); instead it makes a kind of sinusoidal motion, i.e. the angle is somtimes more and sometimes less than 90°, without this however resulting in the axle dragging on the side flank of the blade.

Figure 14:
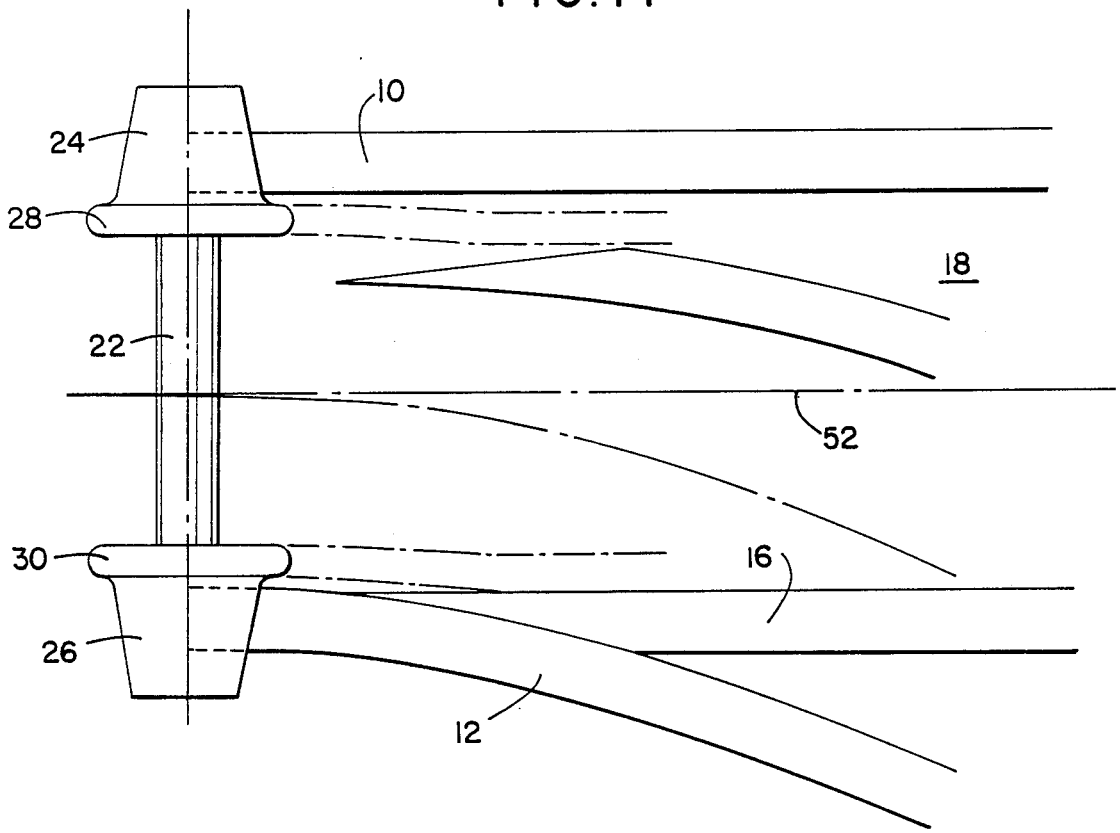
FIG. 14 shows a principle illustration of a wheel axle motion in the transitional area from stock rail to blade rail according to the prior art.

To illustrate clearly the situations described in FIGS. 1 and 2 and FIGS. 3 and 4, FIGS. 14 and 15 show in simplified form how the wheel (24) or (26) with wheel flange (28) or (30) runs in relation to the stock rails (10) and (12) or (32) and (34) and to the right-hand blade rail (16) then to be traversed. FIG. 14 corresponds here to the illustration in FIG. 1. It can be seen that the standard course of the stock rail (12) changes the wheel contact point (46) of wheel (26) on the stock rail (10), resulting in a swivelling of the axle (22) in relation to the longitudinal axis (52) of the main track. The consequence of this is that the wheel flange (30) drags along the blade rail (16), as indicated by the broken line.

Figure 15:
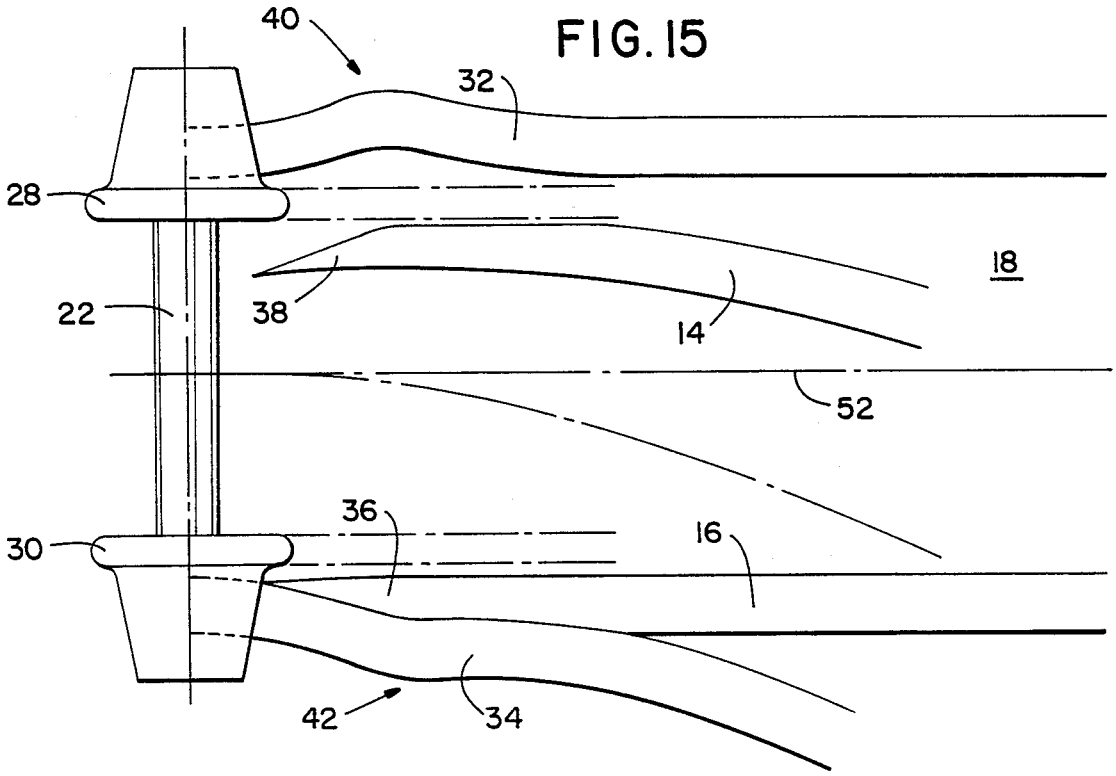
FIG. 15 shows a corresponding principle illustration using the theory according to the invention.

By contrast, FIG. 15 shows how the stock rail (32) or (34) veers away outwards in the transitional area to the blade rails (14) and (16) so that a controlled influence on the wheel contact point (48) or (50) permits the axle (22) to remain in the centre vertical to the longitudinal axis (52) of the main track (18), resulting in an almost straight-line motion of the wheel flange (28) or (30) to the normal direction of the stock rail (32) and thereby also to the blade rail (16). In consequence there is very little or no contact by the wheel flange (30) with the side flank of the blade rail (16), so that wear is greatly reduced and the conditions in the transitional area almost exclusively match those of tracks.

Figure 5:
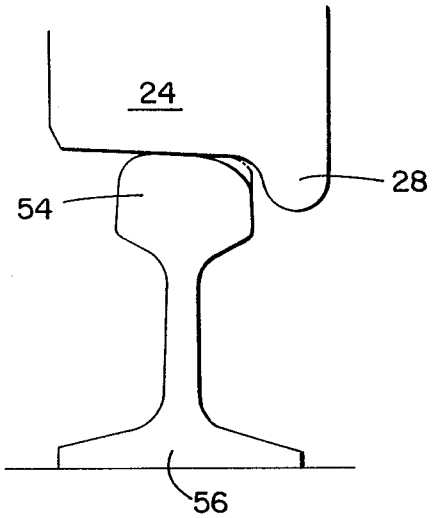

If FIGS. 3 and 15 show the selective influencing of the wheel contact point (48) or (50) by the stock rail veering away in parts from the normal direction before and after the end of the blade (36), (38), there are other possible designs to achieve the same effect. For example, FIG. 5 shows the possibility of machining the rail head (54) of a stock rail (56) in such a way that the running surface is reduced and the area for the wheel contact point thereby restricted. This too ensures that the wheel axle runs substantially vertical to the line axis, i.e. to the longitudinal axis of the main or the branch line.

Figure 6:
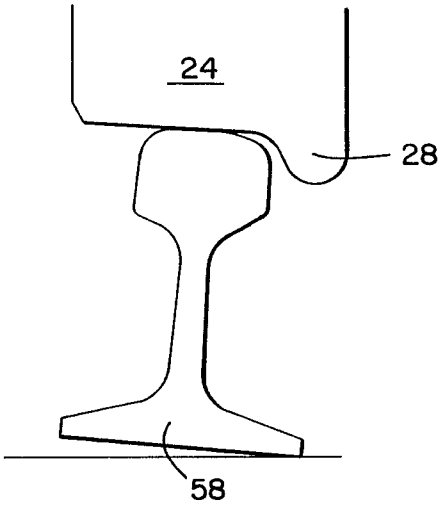

According to FIG. 6, the running surface is reduced by arranging the stock rail (58) at an angle. This can be achieved optionally by a special construction of the rail foot or of the base. In this case too, the result is that the wheel contact point remains largely unchanged on the stock rail (58), so that the wheel axis does not swivel due to the unchanging diameter of the rolling wheel.

Figure 7:
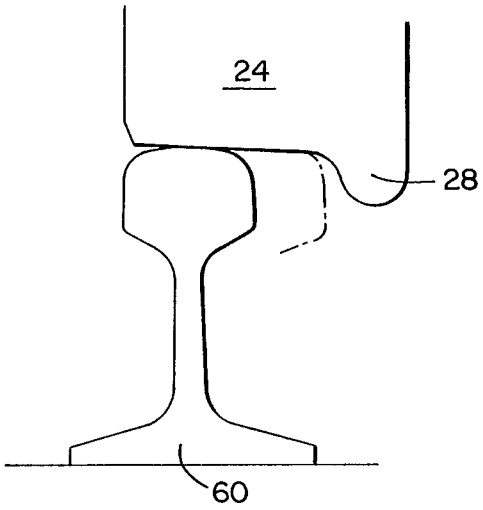

FIG. 7 indicates that a stock rail (60) veers away to the outside in the area where the blade starts, in accordance with FIG. 3 or 15.

Figure 8:
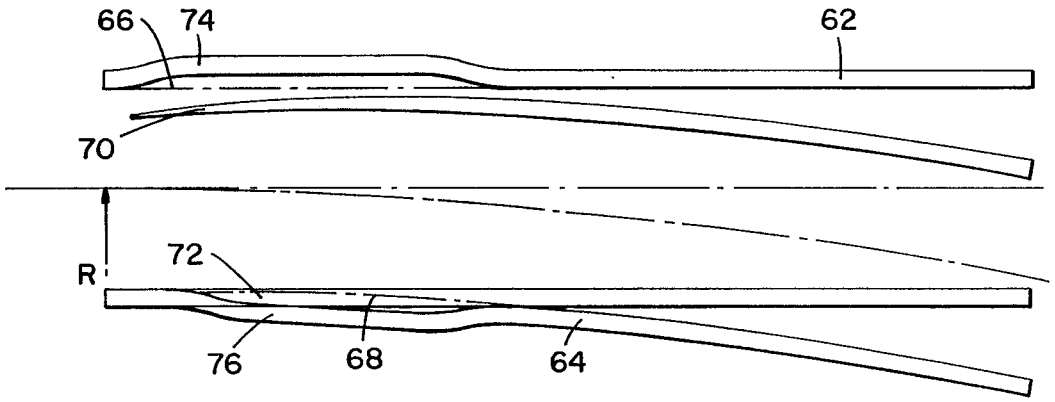
FIGS. 8 to 13 show plan views of sections of further embodiments of points designed in accordance with the invention.

FIGS. 8 to 13 show further embodiments of points areas constructed in accordance with the invention, so achieving track-like conditions in the transitional area of the stock rail to the blade rail, and thereby ensuring that the wheels (24) and (26) substantially carry out a purely rolling motion and do not drag with their flanges (28) or (30) against the flanks of the associated blade rails (14) or (16). In FIG. 8, for example, stock rails (62) and (64) veer away outwards from the normal direction marked by the dash-dotted lines (66) and (68) in the area where the blades (70) and (72) begin, i.e. before and after the beginnings of the blades (70) and (72) the stock rail (62) or (64) runs in the direction indicated by lines (66) and (68) as mentioned. The bulges (74) and (76) are designed symmetrically in relation to the centre line running between the stock rails (62) and (64).

Figure 9:
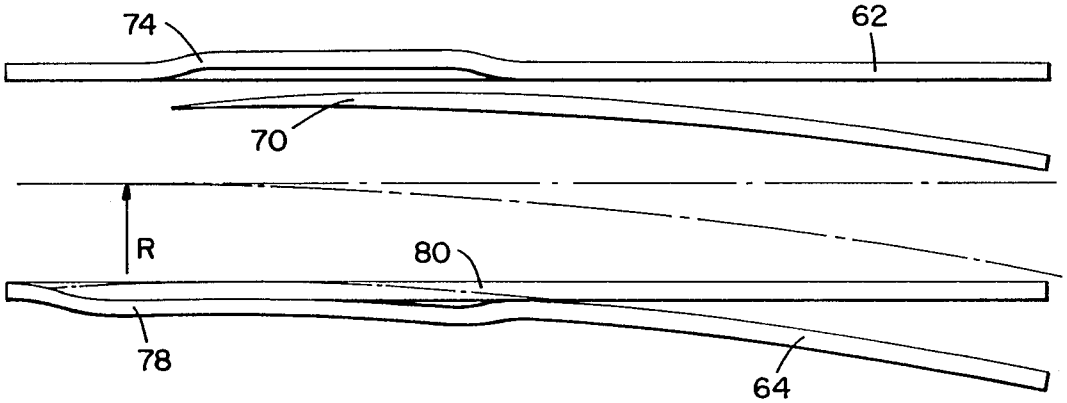

In FIG. 9, the bulge (74) of the stock rail (62) corresponds to that in FIG. 8, whereas the stock rail (64) has a bulge (78) which extends over a longer distance than bulge (74). The associated blade rail (80) is also suitably adapted.

Figure 10:
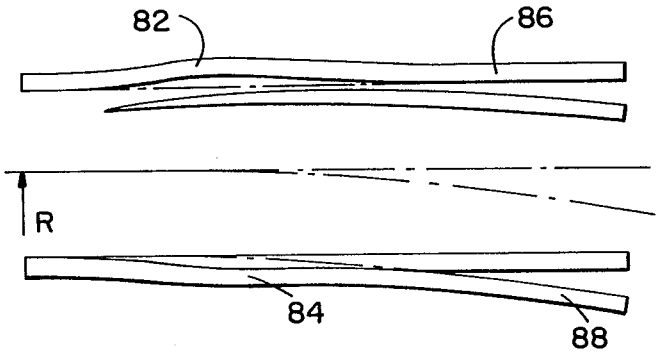

FIG. 10 in its turn is a symmetrical drawing of bulges (82) and (84) in stock rails (86) and (88). The same applies for the embodiment in FIG. 13, where the bulges (90) and (92) are brought forward to the start of the points and the associated blades (94) and (96) begin shortly after the start of the points, to permit a selective influencing of the wheel contact point as early as possible.

Figure 11:
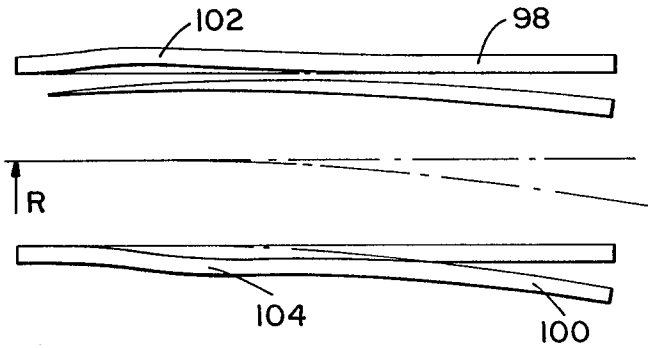
Figure 13:
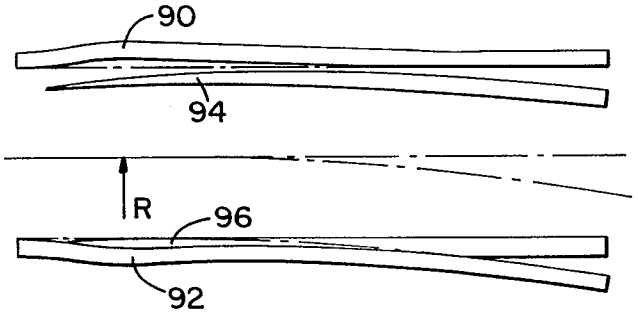
Figure 12:
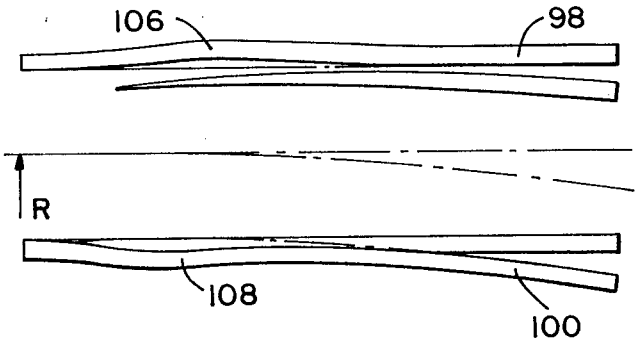

In FIGS. 11 and 12, the bulges (102) and (104), or (106) and (108) arranged in relation to the centre line running between the stock rails (98) and (100) are designed asymmetrically, in order to make allowance for required factors such as the points radius, the line layout or the speed with which the points are to be crossed.

Finally, it should be mentioned that the previously described features according to the invention can be or are also achieved when the branch track is traversed.

FIGS. 16 to 20 again described the substantial features characterizing the invention, with a comparison being made in places with the known structures given in the prior art.

Figure 16:
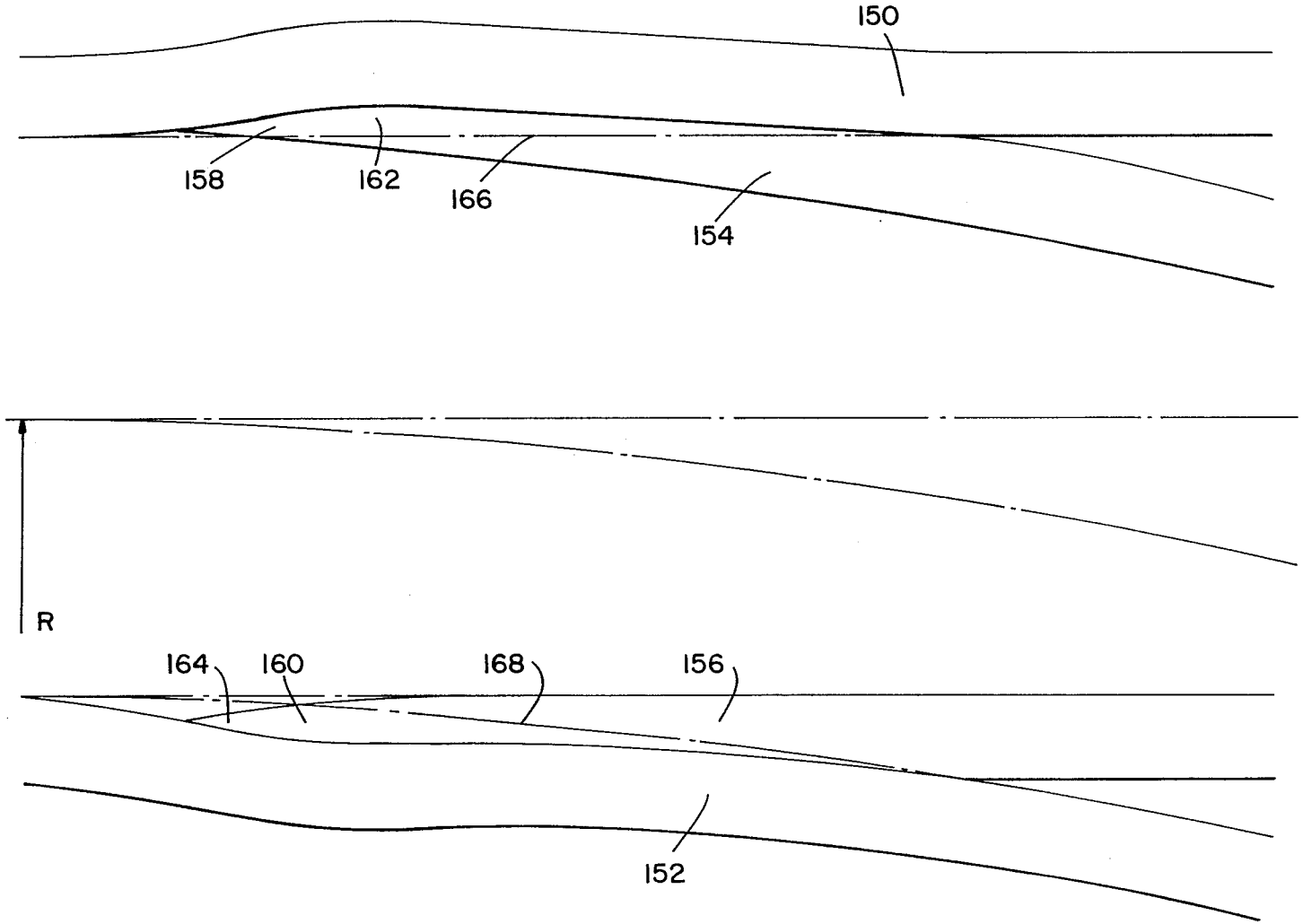
FIG. 16 shows stock rail embodiments according to the invention with switch blades in contact.

FIG. 16 shows stock rails (150) and (152) designed in accordance with the invention and contacted by blade points (154) and (156). In the top part of the figure the branch track is to be traversed and in the bottom part of the figure the main track. It can be seen that the front end (158) or (160) of the switch blade (154) to (156) fits in a bulge (162) or (164) respectively of the stock rail (150) or (152). The bulge, i.e. the deviation from the basic course of the stock rail (150) or (162) indicated by the straight (166) or (168), ensures that the wheels substantially carry out a purely rolling motion in the points area, and not a dragging one that would result in wear on the tracks and rails involving unwelcome and excessive costs. These differences are clearly shown by FIGS. 17 and 19 (prior art) in comparison with figures 18 and 20. It should be noted that the figures show only the basic principles and do not show even approximately the conditions corresponding to the actual embodiments.

Figure 17:
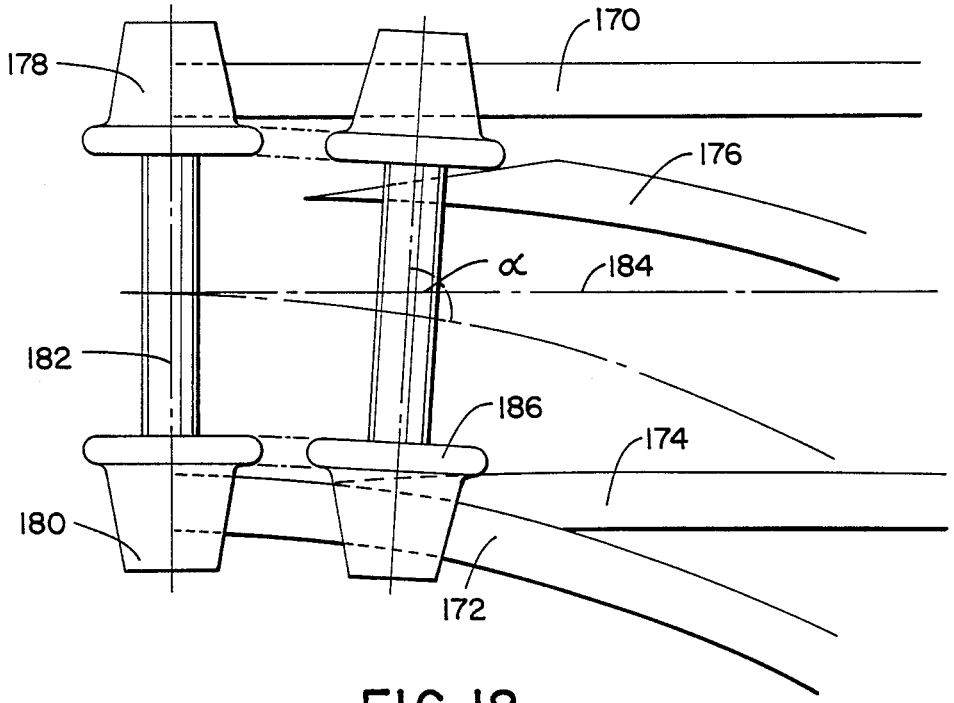
FIG. 17 shows large-arc points designed according to prior art.
Figure 18:
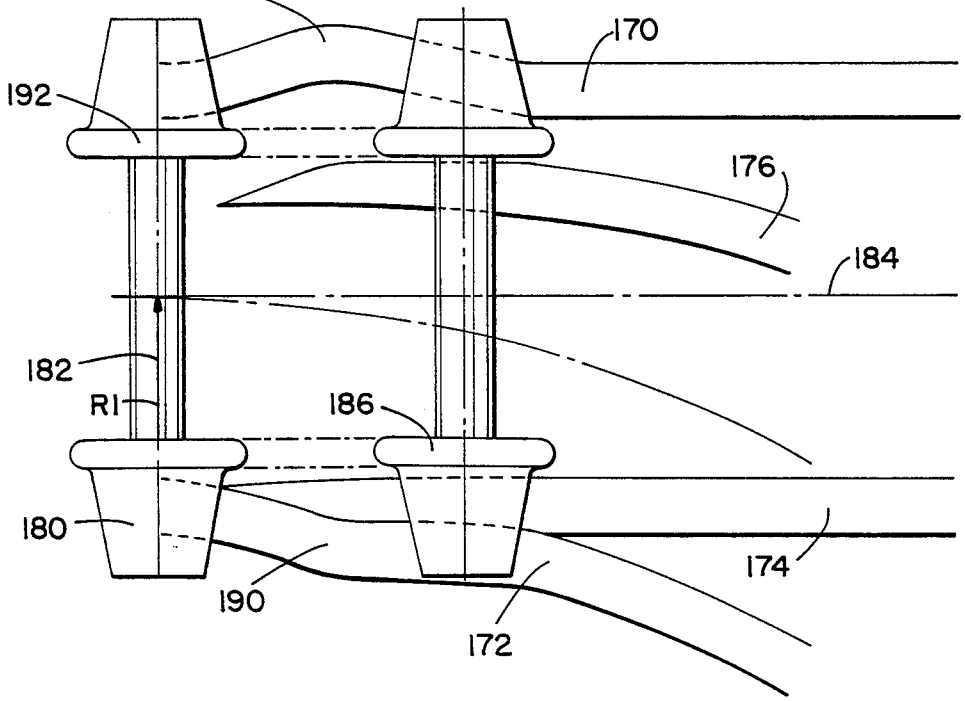
FIG. 18 shows large-arc points designed according to the invention.

FIG. 17 is a section of large-arc points (R preferably in excess of 500,000 mm) to the prior art. The main track is to be traversed, which is given by the stock rail (170) and the switch blade (174) in contact with the opposite stock rail (172). The opposite blade rail (176) is therefore not in contact with the stock rail (174). If a rail vehicle with wheels (178) and (180) now crosses the main track, the wheel axle (182) tries to deviate from the position describing a right angle to the main axis (184) of the main track in front of the points, i.e. to assume an angle $\alpha$ with $\alpha < 90°$. As a result, the wheel flange (182) of the wheel (180) drags along the switch blade (174). This drag is initially intensified, since the wheel contact points of the wheels (178) and (180) on the running surfaces of the stock rail (170) or stock rail (172) and the blade tip (174) are changed such that the effective rolling diameter of wheel (178) compared with that of wheel (180) increases and therefore covers a greater distance.

In accordance with the invention, the stock rail (170) now veers outwards and away from the basic course in or after the beginning of the curve of the points, in order to form a bulge (188) that ensures that the axle (182) attempts before and in the points area to described a right angle in relation to the longitudinal axis. The result of this is an influence on the wheel contact point such that the wheel flange (186) does not carry out a dragging motion along the switch blade (174), but instead substantially a purely rolling motion in the area of the points designed in accordance with the invention.

The stock rail (172) too of the branch track has a corresponding bulge (190) to ensure that here too it is substantially a purely rolling motion that takes place when the branch track is traversed and that there is no dragging motion of the wheel flange (192) along the switch blade (176).

In the case of the large-arc points shown, the change in the course of the stock rail (170) begins preferably in or after the beginning of the curve, whereas the course change of the stock rail (172) of the branch track should begin in the start of the curve.

Figure 19:
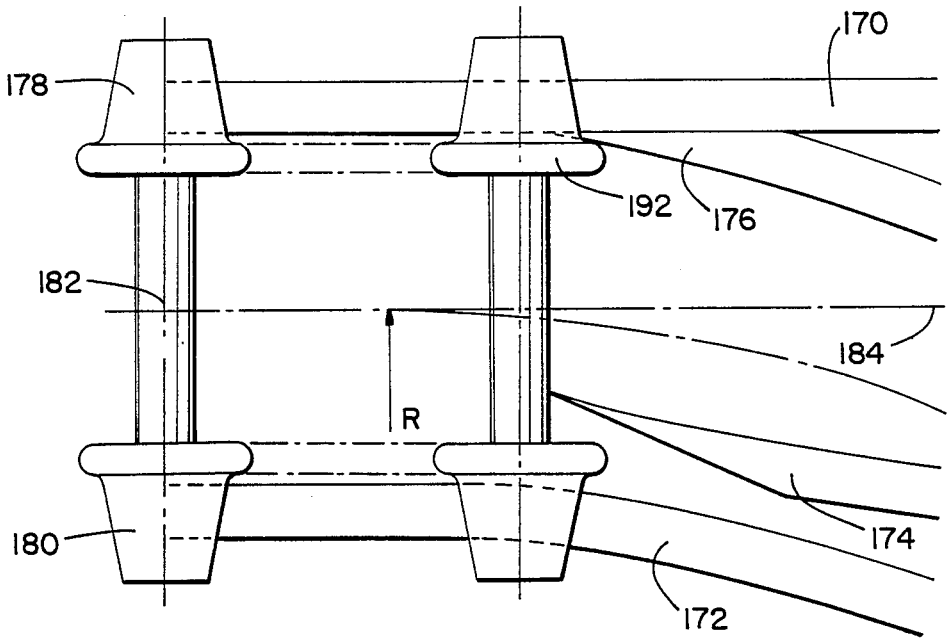
FIG. 19 shows small-arc points according to the prior art.
Figure 20:
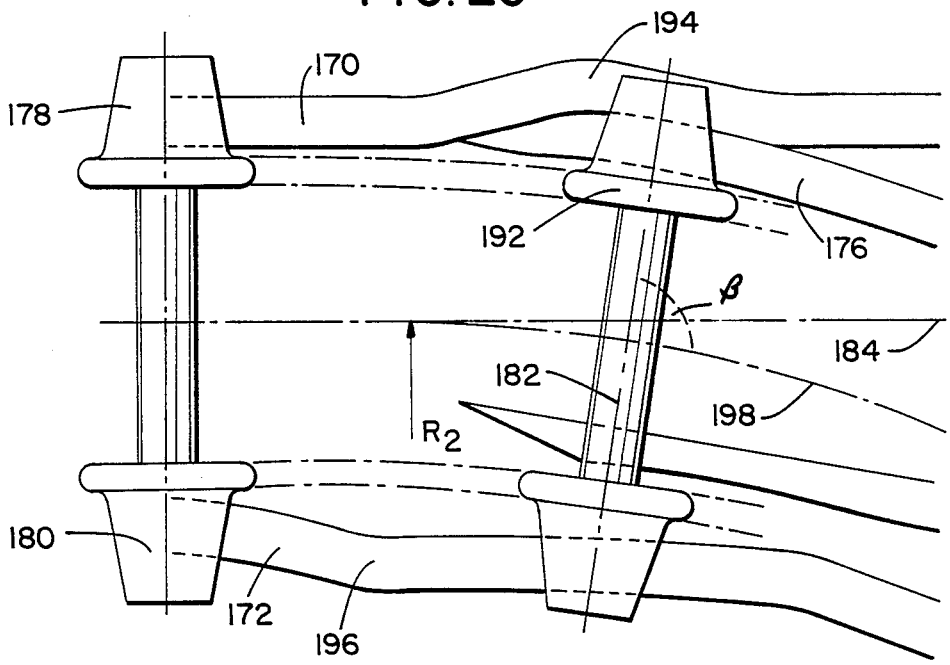
FIG. 20 shows corresponding small-arc points according to the invention.

FIGS. 19 and 20 show a section of small-arc points with a curvature radius of $R_2$ of preferably $R_2 < 500{,}000$ mm. The branch track is to be traversed. According to the prior art (FIG. 19), there is obviously a dragging motion of the wheel flange (192) at the moment the branch track is traversed, since the wheel axle (182) still attempts to take up a substantially right angle to the longitudinal axis (184) of the main track. In accordance with the invention, a course change from the basic course indicated by the course of the stock rails (170) and (172) in FIG. 19 with the effect that the stock rails veer away outwards in parts: The course change in stock rail (170) of the main track takes place in the beginning of the curve, and that of stock rail (172) of the branch track before its beginning, which is indicated by the arrow identified with $R_2$. By appropriate course changes it is ensured that that the wheel flange (192) does not carry out a dragging motion in relation to the switch blade (176), but susbtantially a purely rolling one. This is achieved by the course changes (bulges (194) and (196)) of stock rails (170) and (172), so achieving controlled influencing of the wheel contact points of wheels (178) and (180) such that the wheel axle (182) attempts to described an angle $\beta$ with $\beta \approx 90°$ in relation to the longitudinal axis (198) of the branch track. Of course, the deviations from the basic course of the stock rails can be selected such that the wheel axle (182) adjusts substantially to the angle bisector between the axes (184) and (198), depending on whether priority is to be given to one of the tracks or to both in equal measure.

We claim:

1. An arrangement for controllably guiding an axle means of a rail vehicle as it passes over a switch comprising a branch track and a main track wherein:
   - the branch track and the main track each include a rigid stock rail having a basic course, the stock rails of the branch and main tracks forming an angle;
   - the branch track and the main track each include movable blades;
   - the axle means includes an axle and a wheel at each end portion of the axle;
   - the wheels have frusto-conical portions that are supported on the stock rails at wheel contact points;
   - at least one of the stock rails has, in the region of the switch, a course change from the basic course by means of a bulge which guides the wheel rolling on said at least one stock rail so that it has the same effective rolling diameter as the other wheel, as the other wheel is rolling on the other stock rail, whereby both wheels roll along the rails without dragging thereon as the axle passes over the main track and as the axle passes over the branch track; and
   - the maximum distance between the bulge and the basic course of the at least one stock rail is between 5 and 30 mm.

2. An arrangement according to claim 1, wherein the course change of the stock rail takes place in the beginning of a curvature of the points.

3. An arrangement according to claim 2, wherein, in the case of large-arc points with a curvature radius $r_1$ with $r_1 > 500{,}000$ mm, the course change of the stock rail of the branch track takes place in the beginning of a curvature and the course change of the stock rail of the main track takes place near the beginning of the curvature.

4. An arrangement according to claim 2, wherein in the case of small-arc points with a curvature radius $r_2$ with $r_2 < 500{,}000$ mm, the course change of the stock rail of the main track takes place in the beginning of the curvature and the course change of the stock rail of the branch track takes place before the beginning of the curvature.

5. An arrangement according to claim 1, wherein the location of an end of the stock rail course change in the main track, after the start of a curve, is dependent upon a curvature radius and the width of the head of the main track stock rail.

6. An arrangement according to claim 5, wherein the end x of the course change is described by the equation $x = \sqrt{R^2 - (R-y)^2}$, with $y = cF$, where F is the width of the head of the main track stock rail and c is given by $0.5 \leqq c \leqq 1$.

7. An arrangement according to claim 1, wherein the bulges are formed by straight-line track sections describing angles to one another.

8. An arrangement for controlled guidance of an axle means of a rail vehicle as it passes over a switch comprising a branch track and a main track wherein:
   - the branch track and the main track each include a rigid stock rail, the stock rails of the branch and main tracks forming an angle,
   - the branch track and the main track each include movable blades,
   - the axle means includes an axle and a wheel at each end portion of the axle,
   - the wheels have frusto-conical portions that are each supported on the stock rails at wheel contact points,
   - the cross section of at least one stock rail is changed to guide the wheel rolling on said at least one stock rail so that it has the same effective rolling diameter as the other wheel, as the other wheel is rolling on the other stock rail, whereby both wheels roll along the rails without dragging thereon as the axle passes over the main track and as the axle passes over the branch track.

9. An arrangement according to claim 8, wherein the stock rail has a profile which is flattened off towards the blade for controlled change of the effective wheel rolling diameters.

10. An arrangement according to claim 8, wherein the vertical axis of the stock rail is inclined for controlled change of the effective wheel rolling diameters.

11. An arrangement according to claim 8, wherein the blades have beginning portions which interact with the stock rails in wheel contact areas.

12. A railway switch arrangement for guiding a rail vehicle adapted for use with said switch arrangement as the vehicle's axle means passes over said switch arrangement, the rail vehicle including axle means having wheels with frustoconical portions, and wherein:

the switch arrangement includes a branch track and a main track;

each of the branch and main tracks includes a rigid stock rail defining a basic course;

the stock rails of the branch and main tracks form an angle;

each of the branch and main tracks includes movable blades;

at least one of the stock rails has a bulge which changes the course of said at least one stock rail away from the basic course, the maximum distance between the bulge and the basic course of said at least one stock rail being between 5 and 30 mm;

the bulge guides a wheel of an adapted rail vehicle rolling on said at least one stock rail so that it has the same effective rolling diameter as the other wheel, as the other wheel is rolling on the other stock rail, whereby both wheels roll along the rails without dragging thereon as an adapted rail vehicle's axle means passes over the main track and as an adapted rail vehicle's axle means passes over the branch track.

* * * * *